US009523283B2

(12) United States Patent
Uechi et al.

(10) Patent No.: US 9,523,283 B2
(45) Date of Patent: Dec. 20, 2016

(54) TURBINE VANE

(75) Inventors: Hideyuki Uechi, Tokyo (JP); Tomoko Morikawa, Tokyo (JP); Satoshi Hada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 510 days.

(21) Appl. No.: 13/982,171

(22) PCT Filed: May 10, 2012

(86) PCT No.: PCT/JP2012/062036

§ 371 (c)(1),
(2), (4) Date: Jul. 26, 2013

(87) PCT Pub. No.: WO2012/157527

PCT Pub. Date: Nov. 22, 2012

(65) Prior Publication Data

US 2013/0315725 A1 Nov. 28, 2013

(30) Foreign Application Priority Data

May 13, 2011 (JP) ..... 2011-108399

(51) Int. Cl.
*F01D 9/02* (2006.01)
*F01D 5/18* (2006.01)
*F01D 9/04* (2006.01)

(52) U.S. Cl.
CPC ..... *F01D 9/023* (2013.01); *F01D 5/18* (2013.01); *F01D 5/187* (2013.01); *F01D 5/188* (2013.01);
(Continued)

(58) Field of Classification Search
CPC ..... F01D 9/023; F01D 5/187; F01D 5/18; F01D 5/188
See application file for complete search history.

(56) References Cited

U.S. PATENT DOCUMENTS 4,359,310 A 11/1982 Endres et al.
6,398,486 B1 6/2002 Storey et al.
(Continued)

FOREIGN PATENT DOCUMENTS

DE 102008002890 A1 12/2008
EP 1039096 A2 9/2000
(Continued)

OTHER PUBLICATIONS

Extended European Search Report dated Sep. 30, 2014, issued in corresponding EP patent application No. 12786235.7 (6 pages).
(Continued)

*Primary Examiner* — Igor Kershteyn
*Assistant Examiner* — Eldon Brockman
(74) *Attorney, Agent, or Firm* — Westerman, Hattori, Daniels & Adrian, LLP

(57) ABSTRACT

In a turbine vane and a gas turbine, an outer shroud is fixed to one end of a vane body formed in a hollow shape, an inner shroud is fixed to the other end thereof, and a partition plate is fixed to the inner portions of the vane body, the outer shroud, and the inner shroud, so that a cavity is formed so as to be continuous between the partition plate and the group of the vane body, the outer shroud, and the inner shroud. Then, the vane body, the outer shroud, and the inner shroud are provided with a plurality of cooling holes, and the partition plate is provided with a plurality of penetration holes. Accordingly, since the vane structure or the end wall structure is evenly cooled, a deformation or damage may be suppressed.

8 Claims, 8 Drawing Sheets

(52) U.S. Cl.
CPC ..... *F01D 5/189* (2013.01); *F01D 9/041* (2013.01); *F05D 2240/81* (2013.01); *F05D 2260/201* (2013.01); *F05D 2260/202* (2013.01)

(56) References Cited

U.S. PATENT DOCUMENTS

| | | | | |
|---|---|---|---|---|
| 7,104,756 | B2 * | 9/2006 | Harding | F01D 5/189 416/233 |
| 7,497,655 | B1 * | 3/2009 | Liang | F01D 5/189 415/1 |
| 8,251,665 | B2 * | 8/2012 | Baldauf | F01D 5/22 416/193 A |
| 8,393,867 | B2 * | 3/2013 | Chon | F01D 5/188 416/1 |
| 8,596,961 | B2 * | 12/2013 | Tibbott | F01D 5/188 415/115 |
| 2009/0246023 | A1 * | 10/2009 | Chon | F01D 5/188 416/95 |
| 2010/0124485 | A1 * | 5/2010 | Tibbott | F01D 5/188 415/115 |
| 2010/0310367 | A1 * | 12/2010 | Devore | F01D 5/189 416/1 |
| 2011/0103971 | A1 | 5/2011 | Hada et al. | |

FOREIGN PATENT DOCUMENTS

| | | | |
|---|---|---|---|
| EP | 1626162 | A1 | 2/2006 |
| EP | 1908921 | A2 | 4/2008 |
| JP | 02-52196 | B2 | 11/1990 |
| JP | 2000-282806 | A | 10/2000 |
| JP | 2002-004803 | A | 1/2002 |
| JP | 2006-52725 | A | 2/2006 |
| JP | 2007-518927 | A | 7/2007 |
| JP | 2008-286157 | A | 11/2008 |
| JP | 2009-002340 | A | 1/2009 |
| JP | 2010-515850 | A | 5/2010 |
| WO | 2005/068786 | A1 | 7/2005 |
| WO | 2010/052784 | A1 | 5/2010 |

OTHER PUBLICATIONS

English Translation of Written Opinion of PCT/JP2012/062036, date of mailing Jul. 17, 2012.
International Search Report dated Jul. 17, 2012, issued in corresponding application No. PCT/JP2012/062036.
Written Opinion of PCT/JP2012/062036, mailing date of Jul. 17, 2012.
Decision of a Patent Grant dated Apr. 5, 2016, issued in counterpart Japanese Patent Application No. 2011-108399, with English translation. (3 pages).

* cited by examiner

Related Art

TURBINE VANE

FIELD

The present invention relates to a turbine vane provided in, for example, a gas turbine which supplies a fuel to hot and pressurized compressed air so as to burn the fuel and the air and supplies a generated combustion gas to the turbine so as to obtain a rotational force.

BACKGROUND

A gas turbine includes a compressor, a combustor, and a turbine. Here, air which is taken from an air inlet is compressed by a compressor so as to become hot and pressurized compressed air, a fuel is supplied to the compressed air in a combustor so that the fuel and the air are burned, the hot and pressurized combustion gas drives a turbine, and then a power generator connected to the turbine is driven. In this case, the turbine is formed by alternately arranging a plurality of turbine vanes and a plurality of turbine blades inside a wheel chamber, and the turbine blades are driven by a combustion gas, so that an output shaft connected to the power generator is rotationally driven.

Further, the turbine vane has a structure in which a shroud is fixed to an end of a vane body in the length direction. Then, cooling air is introduced from each shroud into the vane body so as to cool the inner wall surface of the vane body, and the cooling air is discharged from a cooling hole formed in the vane body to the outside so that the cooling air flows along the outer wall surface of the vane body, thereby cooling the outer wall surface of the vane body.

As such a turbine vane, for example, examples are disclosed in Patent Literatures 1 and 2 below. With regard to a steam outlet flow for a rear cavity of a blade profile part disclosed in Patent Literature 1, steam flowing to an outer wall impingement-cools an outer wall surface through an impingement plate, flows into a cavity of a turbine vane, flows into an inner wall, impingement-cools an inner wall surface through an impingement plate, and returns through a returning cavity. Further, with regard to a turbine vane disclosed in Patent Literature 2, cooling air flows from an impingement plate near each shroud into a cavity of the shroud so as to cool the cavity, flows from the impingement plate of a vane body into the cavity of the vane body so as to cool the cavity, and is discharged from a film-cooling hole to the outside.

CITATION LIST

Patent Literature

Patent Literature 1: Japanese Laid-open Patent Publication No. 2002-004803

Patent Literature 2: Japanese Laid-open Patent Publication No. 2008-286157

SUMMARY

Technical Problem

As described above, the turbine vane includes the vane body and each shroud fixed to the end of the vane body. Then, since the temperature of the turbine vane is increased by the combustion gas, there is a need to cool the turbine vane by introducing the cooling air thereinto. In the citation lists, the vane body near the inner wall surface is covered by the impingement plate so as to define the cavity, and each shroud near the inner wall surface is covered by the impingement plate so as to define the different cavity. Then, the cooling air is sequentially introduced through the respective cavities, so that the shroud or the vane body is cooled.

Incidentally, when the cavities are defined by covering the vane body near the inner wall surface and each shroud near the inner wall surface by different impingement plates, there is a need to provide a flange portion near the inner wall surface of each shroud and the vane body in order to fix the impingement plate. Then, the portion of the shroud or the vane body provided with the flange portion may not be sufficiently cooled, and hence a deformation or damage of the vane body may be caused by the high thermal stress.

FIG. 10 is a longitudinal sectional view illustrating a turbine vane of the related art. That is, as illustrated in FIG. 10, a turbine vane of the related art has a structure in which a vane body 001 is connected to a shroud 002 and an impingement plate 003 is disposed therein so as to define a cavity 004. Then, a flange portion 005 is formed near the connection portion between the vane body 001 and the shroud 002, and the impingement plate 003 is fixed to the flange portion 005. In this way, since the flange portion 005 needs to be provided, a curved connection portion 006 obtained by continuously forming the vane body 001 and the shroud 002 is not sufficiently cooled because the combustion gas side wall surface is far from the wall surface near the cavity 004 that is cooled by the collision of the cooling air from a penetration hole 007 of the impingement plate 003. For this reason, a locally high-temperature portion occurs in the combustion gas side wall surface of the curved connection portion 006 obtained by continuously forming the vane body 001 and the shroud 002. Then, a high thermal stress is generated, and hence damage caused by the oxidization thinning and the thermal stress easily occurs.

The invention solves the above-described problems, and it is an object of the invention to provide a turbine vane capable of suppressing a deformation or damage thereof by evenly cooling a vane structure or an end wall structure.

Solution to Problem

According to a turbine vane of the present invention in order to achieve the object, it is characterized that the turbine vane includes: a vane structure formed in a hollow shape; an end wall structure provided in an end of the vane structure; and a partition plate for forming a cavity continuous inside the vane structure and the end wall structure, the partition plate being provided with a plurality of penetration holes.

Accordingly, since the cavity is formed inside the vane structure and the end wall structure in a continuous state by the partition plate with the plurality of penetration holes, the cooling medium introduced thereinto is directly and evenly introduced from the respective penetration holes formed in the partition plate into the cavity. For this reason, the vane structure and the end wall structure may be evenly cooled by the cooling medium, and hence the deformation or the damage of the vane structure and the end wall structure may be suppressed.

In a turbine vane of the present invention, it is characterized that the partition plate is formed in a cylindrical shape, and an end near the end wall structure is enlarged and is fixed to the end wall structure.

Accordingly, since the partition plate is formed in an appropriate shape, it is possible to easily define the cavity which is continuous from the inside of the vane structure to the inside of the end wall structure.

In a turbine vane of the present invention, it is characterized that a protrusion is provided between the vane structure and the partition plate or between the end wall structure and the partition plate so as to suppress the gap therebetween from being narrowed.

Accordingly, even when the vane structure, the end wall structure, and the partition plate are thermally deformed, it is possible to suppress the gap between the partition plate and the group of the vane structure and the end wall structure, that is, the width of the cavity from being narrowed by the protrusions, and hence to evenly cool the vane structure and the end wall structure by the cooling medium at all times.

In a turbine vane of the present invention, it is characterized that the end wall structure includes an outer end wall structure connected to one end of the vane structure and an inner end wall structure connected to the other end of the vane structure, and the partition plate includes an outer partition plate inserted from the outer end wall structure and an inner partition plate inserted from the inner end wall structure.

Accordingly, since the partition plate is divided into the outer partition plate and the inner partition plate, the partition plate may be easily inserted and disposed in the structures, and hence the assembling work efficiency may be improved.

In a turbine vane of the present invention, it is characterized that the outer partition plate and the inner partition plate are formed so that base ends thereof are fixed to the outer end wall structure and the inner end wall structure and leading ends thereof are bonded to each other.

Accordingly, since the leading ends of the outer partition plate and the inner partition plate inserted into the structures are bonded to each other, the high air-tightness may be ensured. Accordingly, the stable cooling performance may be maintained and the bonding portion may be disposed at a position where the bonding operation may be easily performed.

In a turbine vane of the present invention, it is characterized that the outer partition plate and the inner partition plate are formed so that the base ends are fixed to the outer end wall structure and the inner end wall structure and the leading ends are blocked, and are disposed inside the vane structure with a predetermined gap therebetween.

Accordingly, since the leading ends of the outer partition plate and the inner partition plate inserted into the structures are disposed with a predetermined gap therebetween, the number of bonding positions is decreased. Thus, it is possible to decrease the assembling cost and to improve the assembling work efficiency.

In a turbine vane of the present invention, it is characterized that a combustion gas path is provided outside the vane structure and the end wall structure, and the outer partition plate and the inner partition plate are disposed so that the leading ends avoid a portion with the highest combustion gas temperature of a vane body in a length direction.

Accordingly, the leading ends of the outer partition plate and the inner partition plate may not be easily provided with the penetration holes for the cooling operation. Thus, when the portion with the highest combustion gas temperature is disposed so as to avoid the position, the occurrence of the locally high-temperature portion may be suppressed.

Advantageous Effects of Invention

According to the turbine vane of the invention, since the partition plate provided with the plurality of penetration holes is fixed so as to form the cavity continuous inside the vane structure and the end wall structure, the cooling medium introduced into the cavity is directly and evenly introduced from the respective penetration holes of the partition plate into the cavity. Accordingly, it is possible to evenly cool the vane structure and the end wall structure by the cooling medium and to suppress the deformation or the damage of the vane structure and the end wall structure.

DESCRIPTION OF EMBODIMENTS

Hereinafter, preferred embodiments of a turbine vane according to the invention will be described in detail by referring to the accompanying drawings. Furthermore, the invention is not limited to the embodiments. When plural embodiments are present, the respective embodiments may be combined with each other.

First Embodiment

Figure 1:
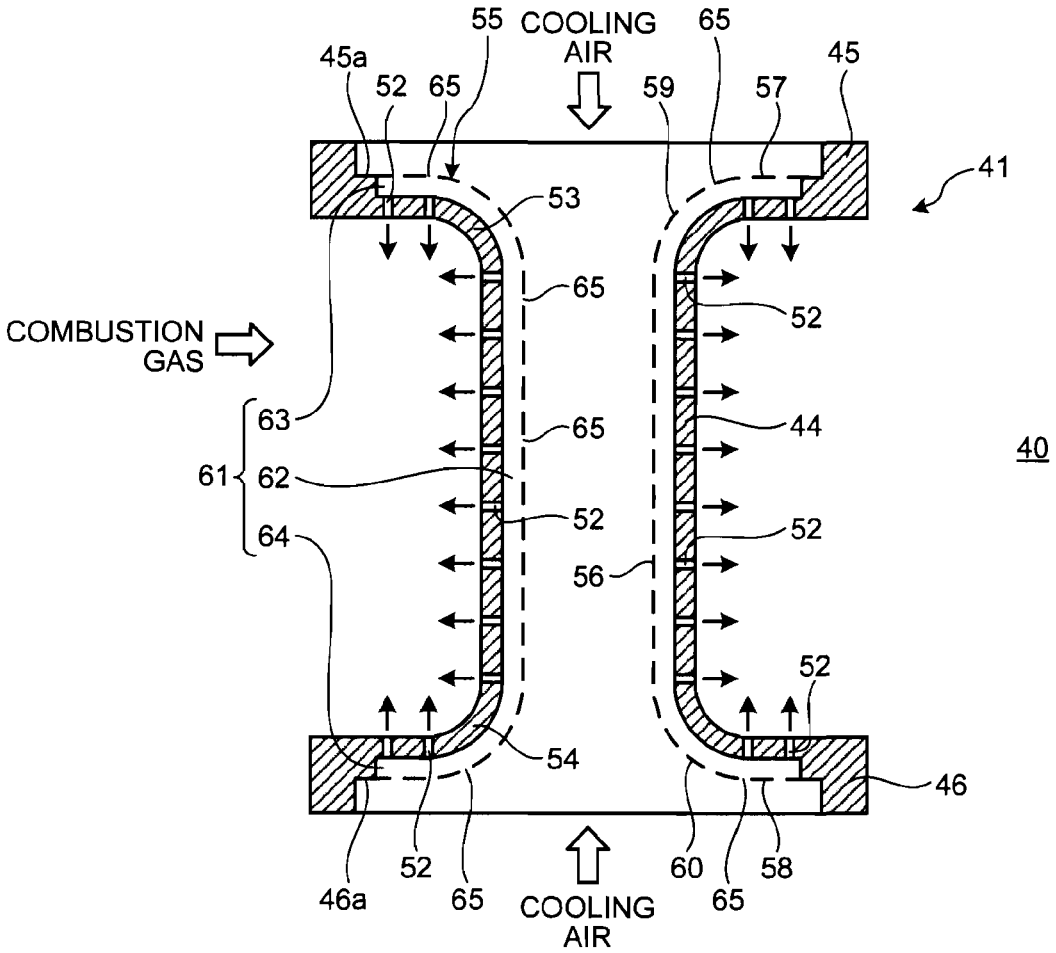
FIG. 1 is a longitudinal sectional view illustrating a turbine vane according to a first embodiment of the invention.
Figure 2:
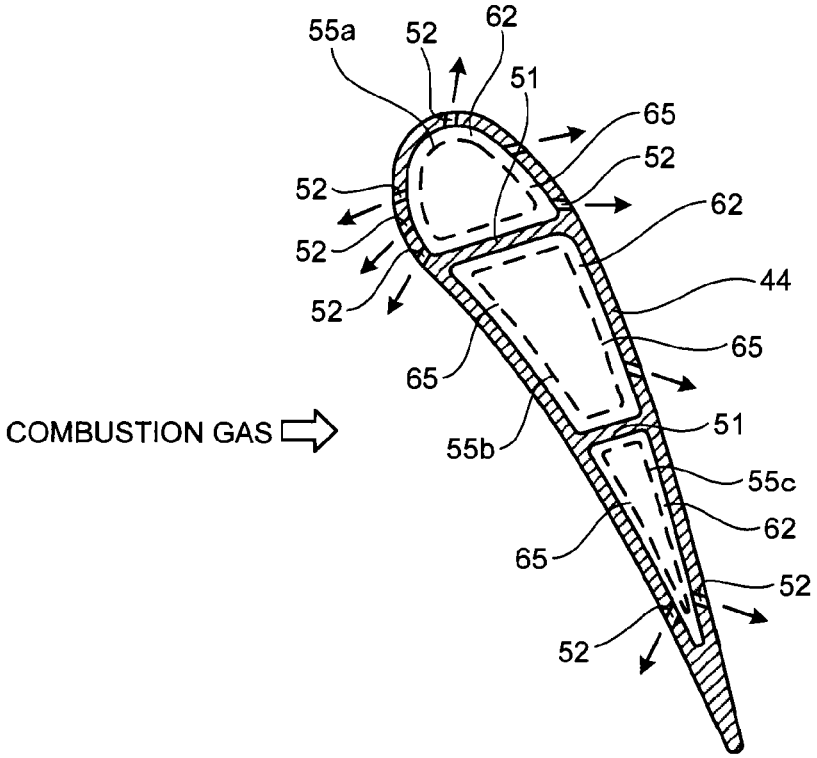
FIG. 2 is a cross-sectional view illustrating the turbine vane of the first embodiment.
Figure 3:
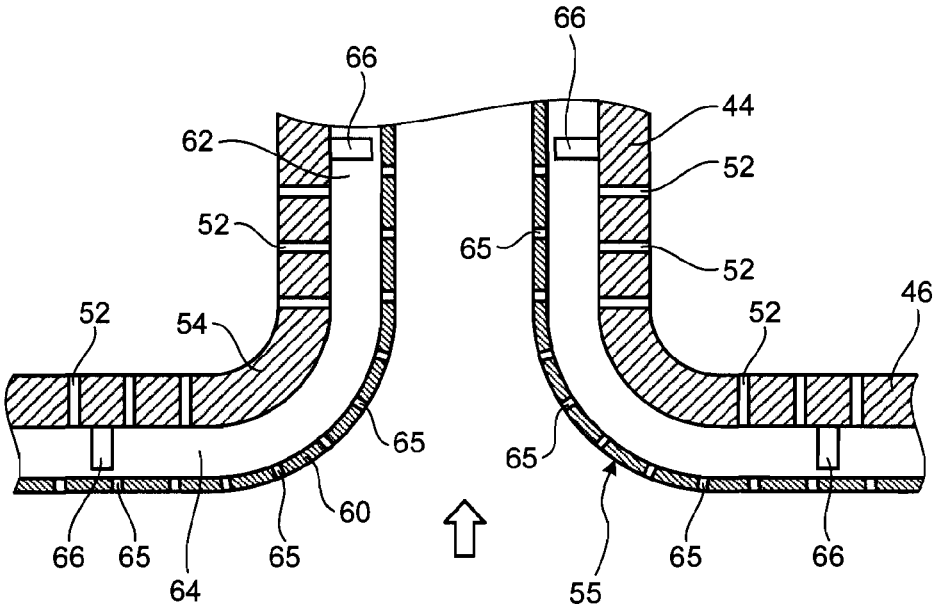
FIG. 3 is a cross-sectional view illustrating a connection portion between an inner shroud and a vane body of the turbine vane of the first embodiment.
Figure 4:
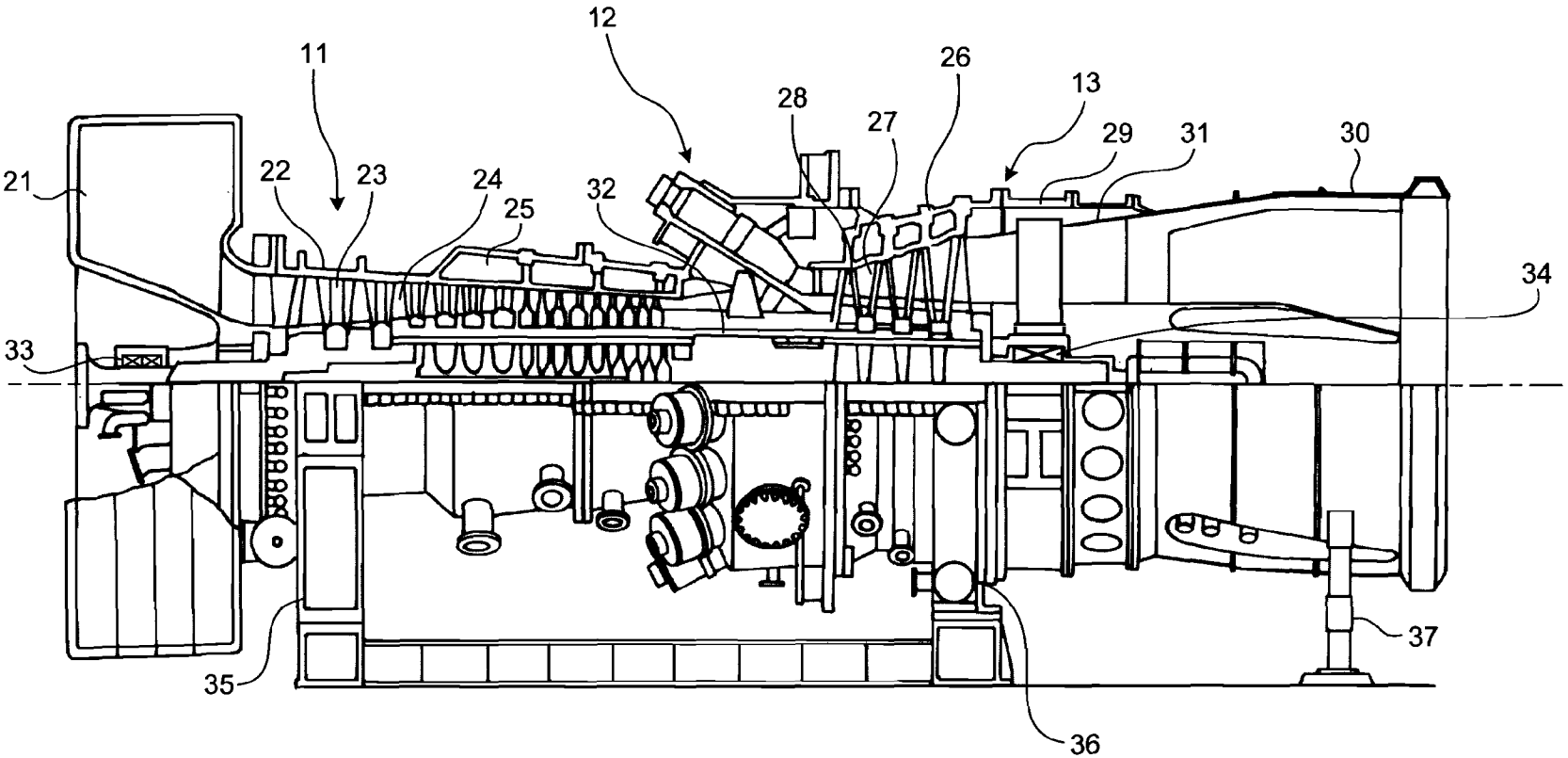
FIG. 4 is a schematic diagram illustrating a gas turbine of the first embodiment.
Figure 5:
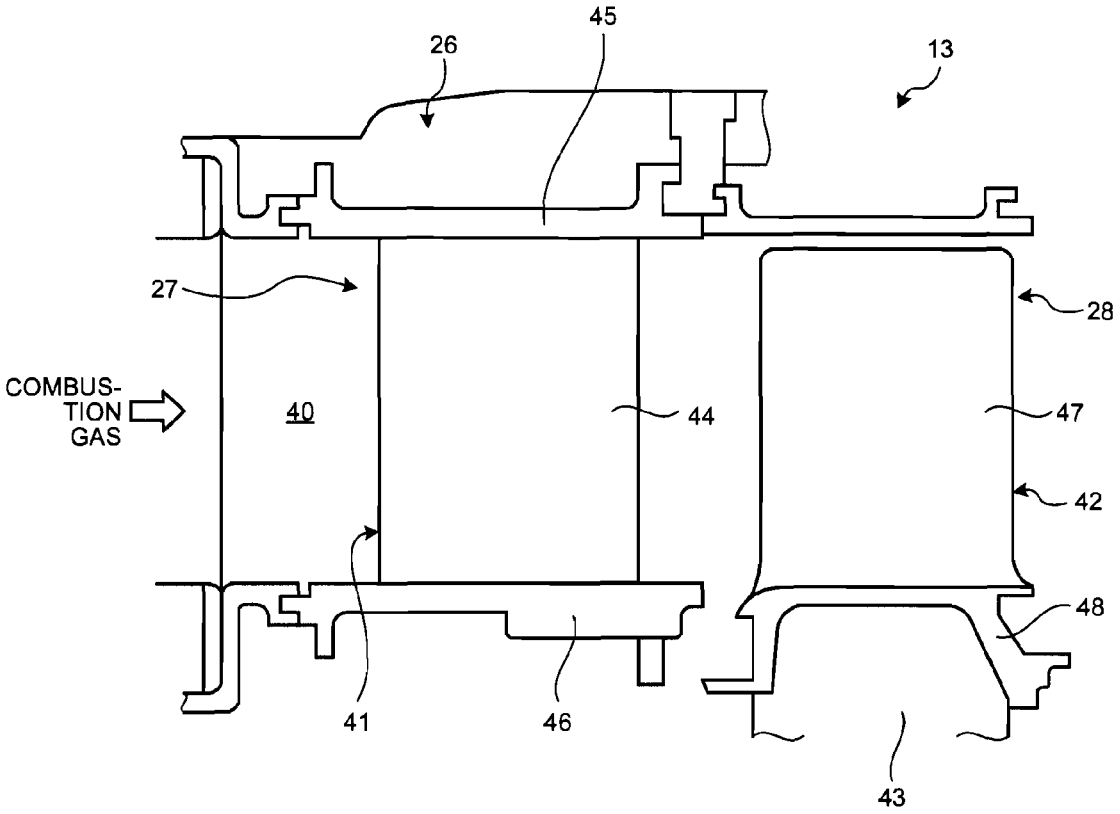
FIG. 5 is a schematic diagram illustrating a turbine of the first embodiment.

FIG. 1 is a longitudinal sectional view illustrating a turbine vane according to a first embodiment of the invention, FIG. 2 is a cross-sectional view illustrating the turbine vane of the first embodiment, FIG. 3 is a cross-sectional view illustrating a connection portion between an inner shroud and a vane body of the turbine vane of the first embodiment, FIG. 4 is a schematic diagram illustrating a gas turbine of the first embodiment, and FIG. 5 is a schematic diagram illustrating a turbine of the first embodiment.

As illustrated in FIG. 4, the gas turbine of the first embodiment includes a compressor 11, a combustor 12, and a turbine 13. The gas turbine is connected with a power generator (not illustrated), so that power may be generated.

The compressor 11 includes an air inlet 21 into which air is taken, where a plurality of turbine vane bodies 23 and a plurality of turbine blade bodies 24 are alternately arranged in the front to rear direction (the axial direction of a rotor 32 to be described below) inside a compressor wheel chamber 22, and air bleeding chambers 25 are provided at the outside thereof. The combustor 12 supplies a fuel to air compressed by the compressor 11 and burns the fuel and the air by the ignition. In the turbine 13, a plurality of turbine vane bodies 27 and a plurality of turbine blade bodies 28 are alternately arranged in the front to rear direction (the axial direction of the rotor 32 to be described below) inside a turbine wheel chamber (casing) 26. A flue gas chamber 30 is disposed at the downstream side of the turbine wheel chamber 26 with the flue gas wheel chamber 29 interposed therebetween, and the flue gas chamber 30 includes a flue gas diffuser 31 which is continuous to the turbine 13.

Further, the rotor (turbine shaft) 32 is positioned so as to penetrate the centers of the compressor 11, the combustor 12, the turbine 13, and the flue gas chamber 30. In the rotor 32, the end near the compressor 11 is rotatably supported by a bearing portion 33, and the end near the flue gas chamber 30 is rotatably supported by a bearing portion 34. Then, in the rotor 32, a plurality of disks attached with the respective turbine blade bodies 24 are fixed to the compressor 11 in an overlapping state, a plurality of disks attached with the respective turbine blade bodies 28 are fixed to the turbine 13 in an overlapping state, and a driving shaft of a power generator (not illustrated) is connected to the end near the compressor 11.

Then, in the gas turbine, the compressor wheel chamber 22 of the compressor 11 is supported by a leg portion 35, the turbine wheel chamber 26 of the turbine 13 is supported by a leg portion 36, and the flue gas chamber 30 is supported by a leg portion 37.

Accordingly, the air which is taken from the air inlet 21 of the compressor 11 is compressed while passing through the plurality of turbine vane bodies 23 and the plurality of turbine blade bodies 24, so that the air becomes compressed air with a high temperature and a high pressure. In the combustor 12, a predetermined fuel is supplied to the compressed air, so that the fuel and the air are burned. Then, the hot and pressurized combustion gas as a hydraulic fluid generated by the combustor 12 passes through the plurality of turbine vane bodies 27 and the plurality of turbine blade bodies 28 constituting the turbine 13, so that the rotor 32 is rotationally driven and the power generator connected to the rotor 32 is driven. Meanwhile, the energy of the flue gas (combustion gas) is converted into a pressure by the flue gas diffuser 31 of the flue gas chamber 30, and the flue gas is discharged to the atmosphere after its speed is decreased.

In the above-described turbine 13, as illustrated in FIG. 5, the turbine wheel chamber 26 which is formed in a cylindrical shape has a combustion gas path 40 which is formed therein so as to have an annular shape, and the plurality of turbine vane bodies 27 and the plurality of turbine blade bodies 28 are alternately arranged in the combustion gas path 40 in the combustion gas flow direction. That is, in the turbine vane bodies 27 of the respective stages, a plurality of turbine vanes 41 are arranged at the same interval in the circumferential direction and are fixed to the turbine wheel chamber 26. Further, in the turbine blade body 28, turbine blades 42 are arranged at the same interval in the circumferential direction and are fixed to a rotor disk 43 of which the base end is fixed to the rotor 32.

In the turbine vane 41, an outer shroud (end wall structure) 45 is fixed to one end (the outside in the radial direction) of a vane body (vane structure) 44 in the length direction (the radial direction of the rotor 32), and an inner shroud (end wall structure) 46 is fixed to the other end (the inside in the radial direction) thereof. Then, the outer shroud 45 is fixed to the turbine wheel chamber 26. Meanwhile, the turbine blade 42 has a structure in which a platform 48 is fixed to the base end (the inside in the radial direction) of the vane body 47 in the length direction (the radial direction of the rotor 32). Then, the platform 48 is fixed to the rotor disk 43, and the leading end (the outside in the radial direction) thereof extends to the vicinity of the inner wall surface of the turbine wheel chamber 26.

In the turbine vane 41 with such a configuration, as illustrated in FIGS. 1 to 3, the vane body 44 is formed in a hollow shape, where the upstream side in the combustion gas flow direction (the left side of FIG. 2) is formed in a curved cross-sectional shape and the downstream side in the combustion gas flow direction (the right side of FIG. 2) is formed in a tapered cross-sectional shape. Then, the inside of the vane body 44 is divided into three spaces by two partition walls 51. Further, the vane body 44 is provided with a plurality of cooling holes 52 which are provided at predetermined positions so as to penetrate the vane body from the inside to the outside thereof.

The outer shroud 45 is formed in a substantially square plate shape, the center thereof is provided with an opening having a vane shape, and one end of the vane body 44 is fixed so as to match the opening. As in the outer shroud 45, the inner shroud 46 is formed in a substantially square plate shape, the center thereof is provided with an opening having a vane shape, and the other end of the vane body 44 is fixed so as to match the opening. In this case, the vane body 44 and the outer shroud 45 are connected to each other through a trumpet-like curved portion 53, and the vane body 44 and the inner shroud 46 are connected to each other through a trumpet-like curved portion 54. Further, the respective shrouds 45 and 46 are provided with a plurality of cooling holes 52 which are formed at predetermined positions so as to penetrate the shrouds from the inside to the outside thereof.

A partition plate 55 is fixed to the inner portions of the vane body 44, the outer shroud 45, and the inner shroud 46. The partition plate 55 is formed in a cylindrical shape, and the ends near the respective shrouds 45 and 46 are enlarged and are fixed to the respective shrouds 45 and 46. That is, the partition plate 55 includes a body 56 which corresponds to the vane body 44, an outer portion 57 which corresponds to the outer shroud 45, and an inner portion 58 which corresponds to the inner shroud 46, and curved portions 59 and 60 which correspond to the respective curved portions 53 and 54 are provided among the body 56, the outer portion 57, and the inner portion 58.

Then, the partition plate 55 is fixed to the inner portions of the vane body 44, the outer shroud 45, and the inner shroud 46, so that a cavity 61 is defined therein. The cavity 61 is obtained by continuously forming a first cavity 62 which is defined by the vane body 44 and the body 56 of the partition plate 55, a second cavity 63 which is defined by the outer shroud 45 and the outer portion 57 of the partition plate 55, and a third cavity 64 which is defined by the inner shroud 46 and the inner portion 58 of the partition plate 55. In this case, the partition plate 55 is disposed so that the gap between the partition plate and the inner wall surfaces of the vane body 44 and the respective shrouds 45 and 46 is substantially even throughout the substantially entire area.

That is, the partition plate 55 is disposed so as to have an even gap between the partition plate and the inner wall surfaces of the vane body 44 and the respective shrouds 45 and 46. Meanwhile, the outer peripheral portions of the respective shrouds 45 and 46 are provided with steps **45*a* and 46*a*, and the respective ends of the partition plate 55 are fixed (welded) to the steps 45*a* and 46*a* in a close contact state. Further, the partition plate 55 is provided with a plurality of penetration holes 65** which are formed at the substantially same interval throughout the entire area thereof.

Furthermore, since the inside of the vane body 44 is divided into three spaces by two partition walls 51 as described above, the cylindrical partition plate 55 (55*a*, 55*b*, and 55*c*) is disposed in each space in actual, and the respective partition plates 55*a*, 55*b*, and 55*c* are connected at the respective shrouds 45 and 46, so that the spaces communicate with one another.

Further, a plurality of protrusions 66 are provided between the group of the vane body 44 and the respective shrouds 45 and 46 and the partition plate 55 so as to suppress the gap from being narrowed. Each protrusion 66 is formed in a columnar or prismatic shape which protrudes from the inner wall surfaces of the vane body 44 and the respective shrouds 45 and 46 toward the partition plate 55, and the leading end thereof is separated from the partition plate 55. In this case, the plurality of protrusions 66 are arranged inside the cavity 61 at the substantially same interval.

Accordingly, when cooling air (cooling medium) obtained from a cooling path (not illustrated) is supplied from the outer shroud 45 and the inner shroud 46 toward the turbine vane 41, the cooling air is first introduced into the vane body 44, the outer shroud 45, and the inner shroud 46, that is, the partition plate 55. Then, the cooling air inside the partition plate 55 is sprayed to the cavity 61 through the plurality of penetration holes 65 formed in the partition plate 55. Here, the inner wall surfaces of the vane body 44, the outer shroud 45, and the inner shroud 46 are impingement-cooled. At this time, the cooling air inside the partition plate 55 is introduced into three cavities 62, 63, and 64 in parallel through the respective penetration holes 65, so that the vane body 44, the outer shroud 45, and the inner shroud 46 are cooled uniformly. Subsequently, the cooling air of the cavity 61 is discharged to the outside (the combustion gas path 40) through the plurality of cooling holes 52, and flows along the outer wall surfaces of the vane body 44, the outer shroud 45, and the inner shroud 46, so that the outer wall surfaces are film-cooled.

In this way, in the turbine vane of the first embodiment, the outer shroud 45 is fixed to one end of the vane body 44 formed in a hollow shape, the inner shroud 46 is fixed to the other end thereof, and the partition plate 55 is fixed to the inner portions of the vane body 44, the outer shroud 45, and the inner shroud 46, so that the continuous cavity 61 is formed between the group of the vane body 44, the outer shroud 45, and the inner shroud 46 and the partition plate 55. Then, the vane body 44, the outer shroud 45, and the inner shroud 46 are provided with the plurality of cooling holes 52, and the partition plate 55 is provided with the plurality of penetration holes 65.

Accordingly, when the cooling air is supplied from the outer shroud 45 and the inner shroud 46, the cooling air is introduced into the partition plate 55 and is sprayed into the cavity 61 through the plurality of penetration holes 65 formed in the partition plate 55. Accordingly, the inner wall surfaces of the vane body 44, the outer shroud 45, and the inner shroud 46 are impingement-cooled. Then, the cooling air is discharged to the outside through the plurality of cooling holes 52 and flows along the outer wall surfaces of the vane body 44, the outer shroud 45, and the inner shroud 46, so that the outer wall surfaces thereof are film-cooled.

At this time, since the cavity 61 (62, 63, and 64) which is continuous to the inner portions of the vane body 44, the outer shroud 45, and the inner shroud 46 is formed by the partition plate 55 with the plurality of penetration holes 65, the cooling air inside the partition plate 55 is directly and evenly introduced into three cavities 62, 63, and 64 in parallel through the respective penetration holes 65. Accordingly, the vane body 44, the outer shroud 45, and the inner shroud 46 may be evenly cooled by the cooling air. Thus, the high temperature and the thermal stress at the local positions of the vane body 44, the outer shroud 45, and the inner shroud 46 are prevented, and hence the deformation of the vane body 44, the outer shroud 45, and the inner shroud 46 and the damage caused by the thermal stress or the oxidization thinning thereof may be suppressed.

Particularly, since the cavity 62 of the vane body 44 is continuous to the cavities 63 and 64 of the respective shrouds 45 and 46, there is no need to provide a flange near the connection portion of the vane body 44 and the shrouds 45 and 46. For this reason, the combustion gas side wall surfaces of the curved portions 53 and 54 connecting the vane body 44 and the shrouds 45 and 46 to each other may be sufficiently cooled without being far from the wall surfaces which are impingement-cooled by the cooling air.

Further, in the turbine vane of the first embodiment, the circuit of the cooling air sprayed to the cavity 62 from the inside of the partition plate 55 (56) of the vane body 44 and the circuit of the cooling air sprayed to the cavities 63 and 64 from the inside of the partition plate 55 (57 and 58) of the respective shrouds 45 and 46 are formed in parallel. In the turbine vane (for example, Patent Literature 1) of the related art, the cooling air sequentially flows in series from the inside of the partition plate of the vane body, the cavity of the vane body, the inside of the partition plate of the shroud, and the cavity of the shroud. For this reason, a member such as a leading edge cavity insertion sleeve capable of dividing the cooling air circuit of the vane body and the cooling air circuit of the shroud portion is provided, and hence a portion which may not be impingement-cooled occurs by the existence of the member that divides the circuits. In the turbine vane of the first embodiment, a member such as a leading edge cavity insertion sleeve does not need to be provided. Accordingly, it is possible to prevent the occurrence of the portion which may not be impingement-cooled and hence to evenly cool the vane body 44 and the respective shrouds 45 and 46.

Further, in the turbine vane of the first embodiment, the vane body 44 and the respective shrouds 45 and 46 which support the turbine vane 41 against the combustion gas force are formed so as to be exposed to the combustion gas. Accordingly, since the member exposed to the combustion gas is formed so as to be thick in that the turbine vane 41 needs to be supported by the member, it is possible to prevent a problem in which damage penetrating the combustion gas path 40 and the cavity 61 by the oxidization thinning caused by the high-temperature combustion gas occurs and the cooling air leaks. Thus, it is possible to obtain the cooling air flow amount distribution and the cavity pressure according to the design and to reliably cool the respective members.

Further, in the turbine vane of the first embodiment, the partition plate 55 is formed in a cylindrical shape, and the ends reaching the respective shrouds 45 and 46 from the vane body 44 are enlarged in a trumpet shape and are fixed to the outer peripheral portions of the respective shrouds 45 and 46. Accordingly, since the partition plate 55 is formed in an appropriate shape, the cavity 61 which is continuous from the inner portion of the vane body 44 to the inner portions of the respective shrouds 45 and 46 is easily formed, the entire area of the cavity 61 may be substantially evenly cooled.

Further, in the turbine vane of the first embodiment, the plurality of protrusions 66 are provided from the vane body 44 and the respective shrouds 45 and 46 toward the partition plate 55 so as to suppress the gap therebetween from being narrowed. Accordingly, even when the vane body 44, the respective shrouds 45 and 46, and the partition plate 55 are thermally deformed, it is possible to suppress the gap between the group of the vane body 44 and the respective shrouds 45 and 46 and the partition plate 55, that is, the width of the cavity 61 from being narrowed by the protrusions 66. Thus, it is possible to supply an appropriate amount of cooling air into the cavity 61 at all times and to evenly cool the vane body 44 and the respective shrouds 45 and 46.

Furthermore, in the first embodiment, the plurality of protrusions 66 which suppress the gap between the group of the vane body 44 and the respective shrouds 45 and 46 and the partition plate 55 from being narrowed are provided so as to protrude from the vane body 44 and the respective shrouds 45 and 46 toward the partition plate 55. However, the protrusions 66 may protrude from the partition plate 55 toward the vane body 44 and the respective shrouds 45 and 46. Further, the shape of the protrusion 66 is not limited to the columnar or prismatic shape, and may be any shape. Then, a shape is desirable in which a large thermal stress does not act on the vane body 44 and the respective shrouds 45 and 46. Then, in the first embodiment, the plurality of protrusions 66 are provided between the group of the vane body 44 and the respective shrouds 45 and 46 and the partition plate 55. However, the plurality of protrusions 66 may be provided only between the vane body 44 and the partition plate 55 or only between at least one of the shrouds 45 and 46 and the partition plate 55.

Second Embodiment

Figure 6:
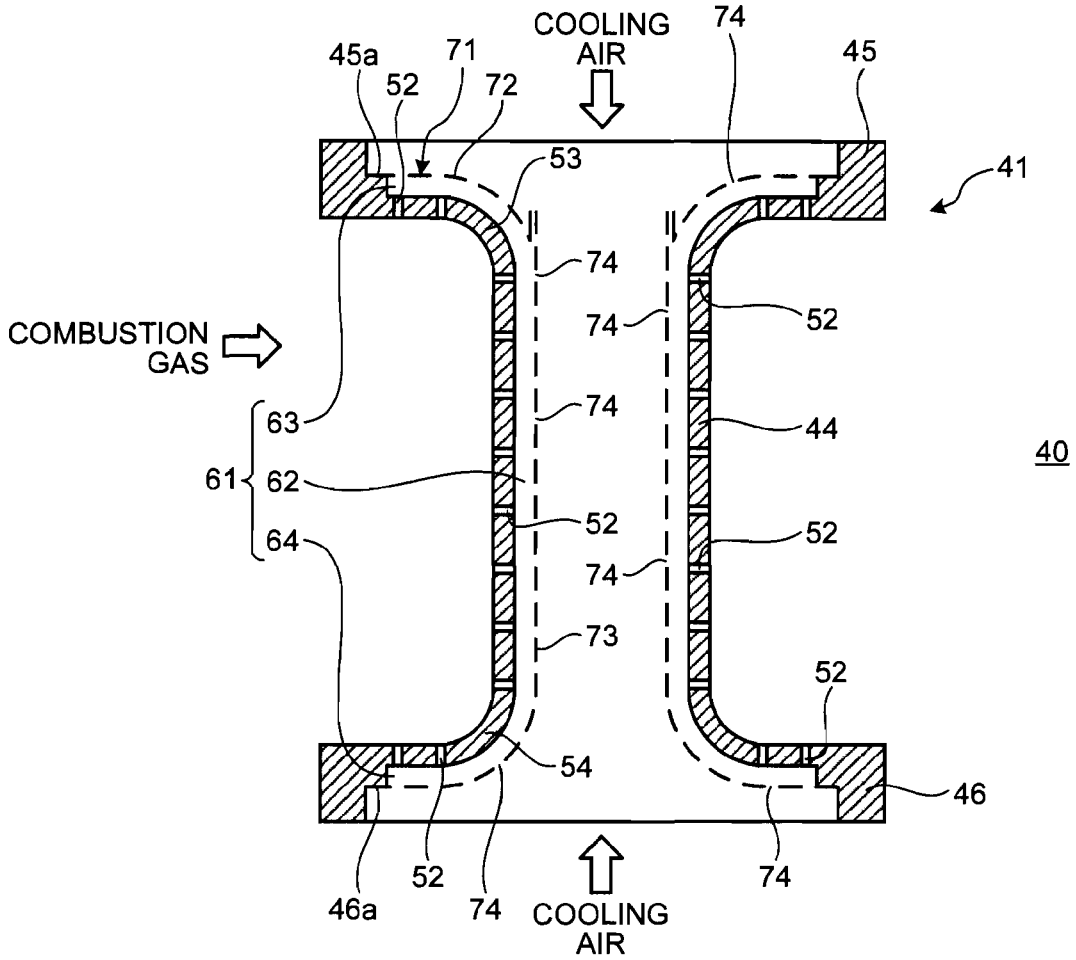
FIG. 6 is a longitudinal sectional view illustrating a turbine vane according to a second embodiment of the invention.
Figure 7:
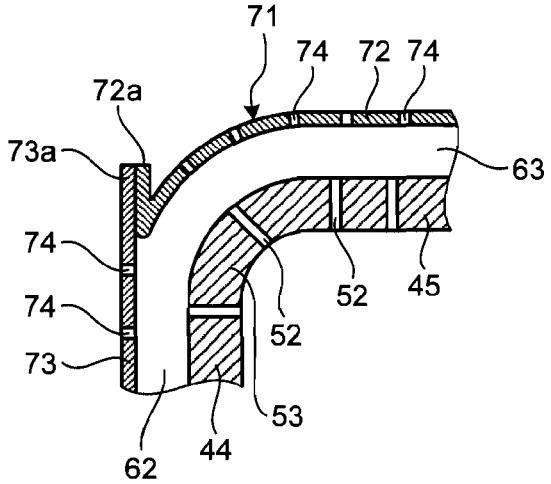
FIG. 7 is a cross-sectional view illustrating a connection portion between an outer shroud and a vane body of the turbine vane of the second embodiment.

FIG. 6 is a longitudinal sectional view illustrating a turbine vane according to a second embodiment of the invention and FIG. 7 is a cross-sectional view illustrating a connection portion between an outer shroud and a vane body of the turbine vane of the second embodiment. Furthermore, the same reference sign will be given to the same component having the same function as that of the above-described embodiment and the detailed description thereof will not be repeated.

In the second embodiment, as illustrated in FIGS. 6 and 7, the turbine vane 41 has a structure in which the outer shroud 45 is fixed to one end of the vane body 44 formed in a hollow shape and the inner shroud 46 is fixed to the other end thereof. Then, the vane body 44, the outer shroud 45, and the inner shroud 46 are provided with the plurality of cooling holes 52.

A partition plate 71 is fixed to the inner portions of the vane body 44, the outer shroud 45, and the inner shroud 46. The partition plate 71 is formed in a cylindrical shape, and the ends near the respective shrouds 45 and 46 are enlarged and are fixed to the respective shrouds 45 and 46. In the second embodiment, the partition plate 71 includes an outer partition plate 72 which is inserted from the outer shroud 45 and an inner partition plate 73 which is inserted from the inner shroud 46. In the outer partition plate 72, the base end thereof is fixed to the outer peripheral portion (step 45*a*) of the outer shroud 45 and a leading end 72*a* is positioned inside the vane body 44. Meanwhile, in the inner partition plate 73, the base end thereof is fixed to the outer peripheral portion (step 46*a*) of the inner shroud 46 and a leading end 73*a* is positioned inside the vane body 44.

In this case, since the inner partition plate 73 is formed so as to be longer than the outer partition plate 72, the leading ends 72*a* and 73*a* of the respective partition plates 72 and 73 are disposed near the outer shroud 45. Then, the leading end 72*a* of the outer partition plate 72 is turned back and the leading end 73*a* of the inner shroud 46 overlaps therein, so that both portions are bonded to each other by welding.

Then, the partition plate 71 is fixed to the inner portions of the vane body 44, the outer shroud 45, and the inner shroud 46, so that the cavity 61 is defined therein. The cavity 61 is obtained by continuously forming the first cavity 62 corresponding to the vane body 44, the second cavity 63 corresponding to the outer shroud 45, and the third cavity 64 corresponding to the inner shroud 46. In this case, the partition plate 71 is disposed throughout the substantially entire area so that the gap between the group of the inner wall surfaces of the vane body 44 and the respective shrouds 45 and 46 and the partition plate is substantially even. Then, the partition plate 71 is provided with a plurality of penetration holes 74 which are formed substantially at the same interval throughout the entire area thereof.

Furthermore, since the operation of the second embodiment is the same as that of the first embodiment, the description thereof will not be repeated.

In this way, in the turbine vane of the second embodiment, the partition plate 71 is fixed to the inner portions of the vane body 44, the outer shroud 45, and the inner shroud 46 so as to form the cavity 61. Then, the vane body 44, the outer shroud 45, and the inner shroud 46 are provided with the plurality of cooling holes 52, and the partition plate 71 is provided with the plurality of penetration holes 74.

Accordingly, since the cavity 61 (62, 63, and 64) which is continuous inside the vane body 44, the outer shroud 45, and the inner shroud 46 is formed by the partition plate 71 with the plurality of penetration holes 74, the cooling air inside the partition plate 71 is directly and evenly introduced to three cavities 62, 63, and 64 in parallel through the respective penetration holes 74. Accordingly, the vane body 44, the outer shroud 45, and the inner shroud 46 may be evenly cooled by the cooling air. Thus, it is possible to prevent the occurrence of the locally high thermal stress and to suppress the occurrence of the deformation or the damage of the vane body 44, the outer shroud 45, and the inner shroud 46.

Further, in the turbine vane of the second embodiment, the partition plate 71 includes the outer partition plate 72 which is inserted from the outer shroud 45 and the inner partition plate 73 which is inserted from the inner shroud 46. Accordingly, since the partition plate 71 is divided into the outer partition plate 72 and the inner partition plate 73, the partition plates may be easily inserted and disposed in the structures, and hence the assembling work efficiency may be improved.

Further, in the turbine vane of the second embodiment, the outer partition plate 72 and the inner partition plate 73 have a structure in which the base ends are fixed to the outer peripheral portions of the outer shroud 45 and the inner shroud 46 and the leading ends 72*a* and 73*a* are bonded to each other inside the vane body 44. Accordingly, since the leading ends 72*a* and 73*a* of the outer partition plate 72 and the inner partition plate 73 inserted into the structures are bonded to each other inside the vane body 44, the high air-tightness may be ensured. Accordingly, the stable cooling performance may be maintained and the bonding portion may be disposed at a position where the bonding operation is easily performed.

Further, in the turbine vane of the second embodiment, the leading ends 72*a* and 73*a* of the outer partition plate 72 and the inner partition plate 73 are disposed and bonded near the outer shroud 45. Accordingly, since the bonding portion between the outer partition plate 72 and the inner partition plate 73 is disposed near the outer shroud 45, both portions may be easily bonded to each other from the outside by welding or the like, and hence the assembling work efficiency may be improved. Further, since the leading end of the outer partition plate 72 or the inner partition plate 73 may not be easily provided with the penetration holes 74 used for the cooling operation, the positions of the leading ends 72*a* and 73*a* of the respective partition plates 72 and 73 are disposed near the outer shroud 45 so as to avoid the portion with a high combustion gas temperature, and hence the occurrence of the locally high-temperature portion may be suppressed.

Furthermore, in the second embodiment, the leading ends 72*a* and 73*a* of the outer partition plate 72 and the inner partition plate 73 are disposed and bonded to each other near the outer shroud 45. However, the leading ends 72*a* and 73*a* of the outer partition plate 72 and the inner partition plate 73 may be disposed and bonded to each other near the inner shroud 46. Even in this case, the above-described operation and effect may be obtained.

Third Embodiment

Figure 8:
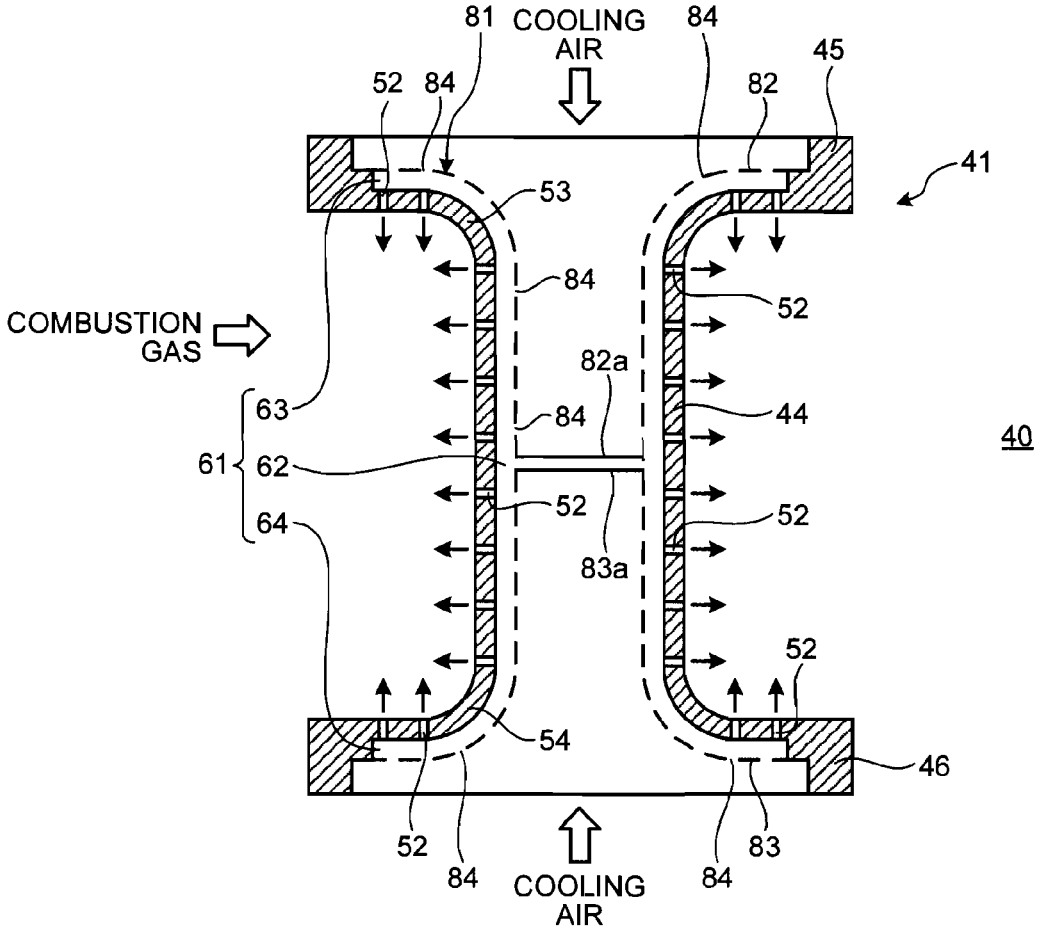
FIG. 8 is a longitudinal sectional view illustrating a turbine vane according to a third embodiment of the invention.

FIG. 8 is a longitudinal sectional view illustrating a turbine vane according to a third embodiment of the invention. Furthermore, the same reference sign will be given to the same component having the same function as that of the above-described embodiments and the detailed description thereof will not be repeated.

In the third embodiment, as illustrated in FIG. 8, the turbine vane 41 has a structure in which the outer shroud 45 is fixed to one end of the vane body 44 formed in a hollow shape and the inner shroud 46 is fixed to the other end thereof. Then, the vane body 44, the outer shroud 45, and the inner shroud 46 are provided with the plurality of cooling holes 52.

A partition plate 81 is fixed to the inner portions of the vane body 44, the outer shroud 45, and the inner shroud 46. The partition plate 81 is formed in a cylindrical shape, and the ends near the respective shrouds 45 and 46 are enlarged and are fixed to the respective shrouds 45 and 46. In the third embodiment, the partition plate 81 includes an outer partition plate 82 which is inserted from the outer shroud 45 and an inner partition plate 83 which is inserted from the inner shroud 46. In the outer partition plate 82, the base end thereof is fixed to the outer peripheral portion of the outer shroud 45 and a leading end 82*a* is positioned inside the vane body 44. Meanwhile, in the inner partition plate 83, the base end thereof is fixed to the outer peripheral portion of the inner shroud 46 and a leading end 83*a* is positioned inside the vane body 44.

In this case, since the outer partition plate 82 and the inner partition plate 83 are formed with the substantially same length, the leading ends 82*a* and 83*a* of the partition plates 82 and 83 are disposed at the middle portion of the vane body 44 in the length direction. Then, the outer partition plate 82 and the inner partition plate 83 are separated from each other with a predetermined gap therebetween so that the leading ends 82*a* and 83*a* are blocked.

Then, the partition plate 81 is fixed to the inner portions of the vane body 44, the outer shroud 45, and the inner shroud 46, so that the cavity 61 is defined therein. The cavity 61 is obtained by continuously forming the first cavity 62 corresponding to the vane body 44, the second cavity 63 corresponding to the outer shroud 45, and the third cavity 64 corresponding to the inner shroud 46. In this case, the partition plate 81 is disposed so that the gap between the partition plate and the inner wall surfaces of the vane body 44 and the respective shrouds 45 and 46 is substantially even throughout the substantially entire area. Then, the partition plate 81 is provided with a plurality of penetration holes 84 which are formed at the substantially same interval throughout the entire area thereof.

Furthermore, since the operation of the third embodiment is the same as that of the first embodiment, the description thereof will not be repeated.

In this way, in the turbine vane of the third embodiment, the cavity 61 is formed by fixing the partition plate 81 to the inner portions of the vane body 44, the outer shroud 45, and the inner shroud 46. Then, the vane body 44, the outer shroud 45, and the inner shroud 46 are provided with the plurality of cooling holes 52, and the partition plate 81 is provided with the plurality of penetration holes 84.

Accordingly, since the cavity 61 (62, 63, and 64) which is continuous inside the vane body 44, the outer shroud 45, and the inner shroud 46 is formed by the partition plate 81 with the plurality of penetration holes 84, the cooling air inside the partition plate 81 is directly and evenly introduced to three cavities 62, 63, and 64 in parallel through the respective penetration holes 84. Accordingly, the vane body 44, the outer shroud 45, and the inner shroud 46 may be evenly cooled by the cooling air. Thus, it is possible to prevent the occurrence of the locally high thermal stress and to suppress the occurrence of the deformation or the damage of the vane body 44, the outer shroud 45, and the inner shroud 46.

Further, in the turbine vane of the third embodiment, the partition plate 81 includes the outer partition plate 82 which is inserted from the outer shroud 45 and the inner partition plate 83 which is inserted from the inner shroud 46, and the outer partition plate 82 and the inner partition plate 83 are disposed with a predetermined gap therebetween at the middle position of the vane body 44 so that the leading ends 82*a* and 83*a* thereof are blocked. Accordingly, since the leading ends 82*a* and 83*a* of the outer partition plate 82 and the inner partition plate 83 inserted into the structures are disposed with a predetermined gap therebetween, the number of bonding positions in the partition plate 81 is decreased. Thus, it is possible to decrease the assembling cost and to improve the assembling work efficiency.

Fourth Embodiment

Figure 9:
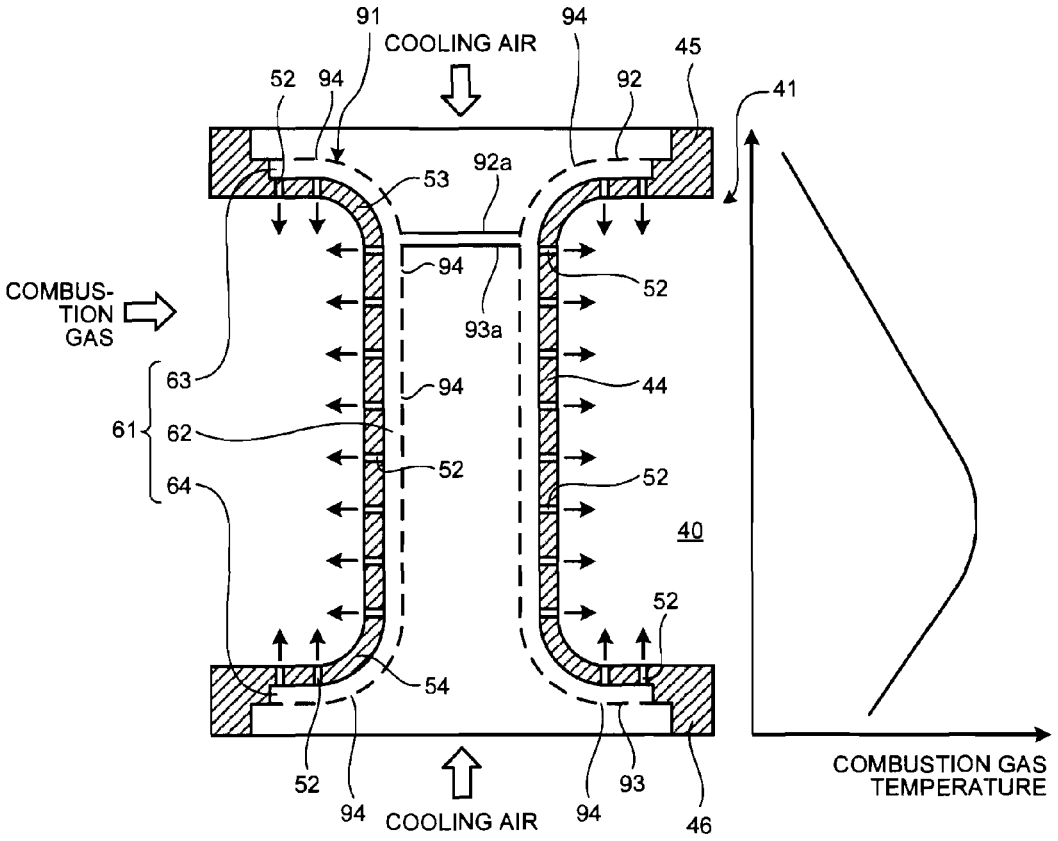
FIG. 9 is a longitudinal sectional view illustrating a turbine vane according to a fourth embodiment of the invention.
Figure 10:
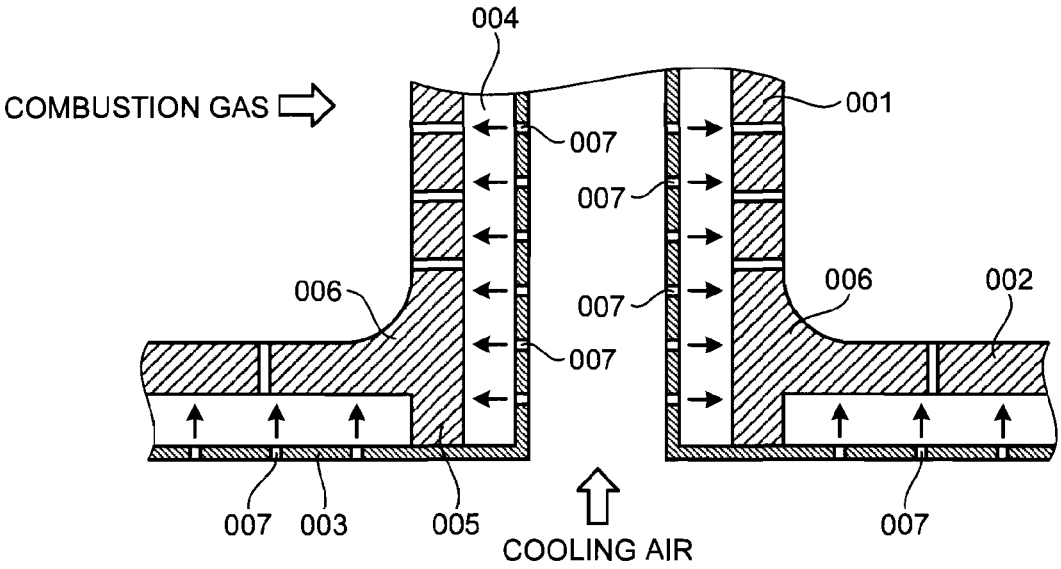
FIG. 10 is a longitudinal sectional view illustrating a turbine vane of the related art.

FIG. 9 is a longitudinal sectional view illustrating a turbine vane according to a fourth embodiment of the invention. Furthermore, the same reference sign will be given to the same component having the same function as that of the above-described embodiments and the detailed description thereof will not be repeated.

In the fourth embodiment, as illustrated in FIG. 9, the turbine vane 41 has a structure in which the outer shroud 45 is fixed to one end of the vane body 44 formed in a hollow shape and the inner shroud 46 is fixed to the other end thereof. Then, the vane body 44, the outer shroud 45, and the inner shroud 46 are provided with the plurality of cooling holes 52.

A partition plate 91 is fixed to the inner portions of the vane body 44, the outer shroud 45, and the inner shroud 46. The partition plate 91 is formed in a cylindrical shape, and the ends near the respective shrouds 45 and 46 are enlarged and are fixed to the respective shrouds 45 and 46. In the fourth embodiment, the partition plate 91 includes an outer partition plate 92 which is inserted from the outer shroud 45 and the inner partition plate 93 which is inserted from the inner shroud 46. In the outer partition plate 92, the base end thereof is fixed to the outer peripheral portion of the outer shroud 45 and a leading end 92*a* is positioned inside the vane body 44. Meanwhile, in the inner partition plate 93, the base end thereof is fixed to the outer peripheral portion of the inner shroud 46 and a leading end 93*a* is positioned inside the vane body 44.

In this case, since the inner partition plate 93 is formed so as to be longer than the outer partition plate 92, the leading ends 92*a* and 93*a* of the partition plates 92 and 93 are disposed near the outer shroud 45 so as to avoid the portion with a high combustion gas temperature of the vane body 44 in the length direction. Then, the outer partition plate 92 and the inner partition plate 93 are separated from each other with a predetermined gap therebetween so that the leading ends 92*a* and 93*a* are blocked.

Then, the cavity 61 is defined by fixing the partition plate 91 to the inner portions of the vane body 44, the outer shroud 45, and the inner shroud 46. The cavity 61 is obtained by continuously forming the first cavity 62 corresponding to the vane body 44, the second cavity 63 corresponding to the outer shroud 45, and the third cavity 64 corresponding to the inner shroud 46. In this case, the partition plate 91 is disposed so that the gap between the partition plate and the inner wall surfaces of the vane body 44 and the respective shrouds 45 and 46 are substantially even throughout the substantially entire area. Then, the partition plate 91 is provided with a plurality of penetration holes 94 which are formed at the substantially same interval throughout the entire area.

Furthermore, since the operation of the fourth embodiment is the same as that of the first embodiment, the description thereof will not be repeated.

In this way, in the turbine vane of the fourth embodiment, the cavity 61 is formed by fixing the partition plate 91 to the inner portions of the vane body 44, the outer shroud 45, and the inner shroud 46. Then, the vane body 44, the outer shroud 45, and the inner shroud 46 are provided with the plurality of cooling holes 52, and the partition plate 91 is provided with the plurality of penetration holes 94.

Accordingly, since the cavity 61 (62, 63, and 64) which is continuous inside the vane body 44, the outer shroud 45, and the inner shroud 46 is formed by the partition plate 91 with the plurality of penetration holes 94, the cooling air inside the partition plate 91 is directly and evenly introduced to three cavities 62, 63, and 64 in parallel through the respective penetration holes 94. Accordingly, the vane body 44, the outer shroud 45, and the inner shroud 46 may be evenly cooled by the cooling air. Thus, it is possible to prevent the occurrence of the locally high thermal stress and to suppress the occurrence of the deformation or the damage of the vane body 44, the outer shroud 45, and the inner shroud 46.

Further, in the turbine vane of the fourth embodiment, the partition plate 91 includes the outer partition plate 92 which is inserted from the outer shroud 45 and the inner partition plate 93 which is inserted from the inner shroud 46, and the outer partition plate 92 and the inner partition plate 93 are disposed with a predetermined gap therebetween near the outer shroud 45 in the vane body 44 so that the leading ends 92*a* and 93*a* are blocked. Accordingly, since the leading ends 92*a* and 93*a* of the outer partition plate 92 and the inner partition plate 93 inserted into the structures are disposed with a predetermined gap therebetween, the number of bonding positions in the partition plate 91 is decreased. Thus, it is possible to decrease the assembling cost and to improve the assembling work efficiency.

Further, in the turbine vane of the fourth embodiment, the leading ends 92*a* and 93*a* of the outer partition plate 92 and the inner partition plate 93 are disposed near the outer shroud 45. That is, the leading ends 92*a* and 93*a* of the outer partition plate 92 and the inner partition plate 93 are disposed so as to avoid the portion with the highest combustion gas temperature. Accordingly, since the leading end of the outer partition plate 92 or the inner partition plate 93 may not be easily provided with the penetration holes 94 used for the cooling operation, the positions of the leading ends 92*a* and 93*a* of the respective partition plates 92 and 93 are disposed near the outer shroud 45 so as to avoid the portion with a high combustion gas temperature of the vane body 44 in the length direction. Thus, it is possible to prevent the portion which is not easily provided with the penetration holes 94 and the portion with a high combustion gas temperature from overlapping each other and to suppress the occurrence of the locally high-temperature portion.

In this case, in the turbine vane 41, the portion with the highest combustion gas temperature changes depending on the state of the combustion gas flowing to the combustion gas path 40. In the fourth embodiment, since the portion with the highest combustion gas temperature is present near the inner shroud 46 in relation to the middle portion of the turbine vane 41 in the length direction, the leading ends 92*a* and 93*a* of the outer partition plate 92 and the inner partition plate 93 are disposed near the outer shroud 45. Here, the portion with the highest combustion gas temperature changes depending on the state of the combustion gas flowing to the combustion gas path 40. For this reason, when the portion with the highest combustion gas temperature is present near the outer shroud 45 in relation to the middle portion of the turbine vane 41 in the length direction, the leading ends 92*a* and 93*a* of the outer partition plate 92 and the inner partition plate 93 may be disposed near the inner shroud 46.

Furthermore, in the above-described embodiments, the cavity 61 is formed by fixing each of the partition plates 55, 71, 81, and 91 to the inner portions of the vane body 44, the outer shroud 45, and the inner shroud 46. However, the cavity may be formed just by fixing the partition plate to the vane body 44 and the outer shroud 45 or to the vane body 44 and the inner shroud 46.

Further, in the above-described embodiments, the cooling air (cooling medium) is supplied from the outer shroud 45 and the inner shroud 46 toward the turbine vane 41, but may be supplied from any one of the outer shroud 45 and the inner shroud 46.

Further, in the second to the fourth embodiments described above, the leading ends of the outer partition plates 72, 82, and 92 and the inner partition plates 73, 83, and 93 are bonded to one another inside the vane body 44, but may be bonded to one another inside the outer shroud 45 or the inner shroud 46.

Further, in the above-described embodiments, a case has been described in which the turbine vane of the invention is applied to the gas turbine, but the turbine vane may be applied to a steam turbine. In this case, the cooling medium is steam, and the steam having been used to cool the cavity may be collected to the shroud without being discharged to the outside.

REFERENCE SIGNS LIST

11 COMPRESSOR
12 COMBUSTOR
13 TURBINE
26 TURBINE WHEEL CHAMBER
27 TURBINE VANE BODY
28 TURBINE BLADE BODY
32 ROTOR
40 COMBUSTION GAS PATH

41 TURBINE VANE
42 TURBINE BLADE
43 ROTOR DISK
44 VANE BODY (VANE STRUCTURE)
45 OUTER SHROUD (END WALL STRUCTURE)
46 INNER SHROUD (END WALL STRUCTURE)
52 COOLING HOLE
55, 71, 81, 91 PARTITION PLATE
61, 62, 63, 64 CAVITY
65, 74, 84, 94 PENETRATION HOLE
66 PROTRUSION

The invention claimed is:

1. A turbine vane comprising:

a vane structure formed in a hollow shape;

an end wall structure provided in an end of the vane structure; and a partition plate including a body portion which corresponds to the vane structure, an end portion which corresponds to the end wall structure, and a curved portion, which extends from the body portion to the end portion, is provided between the body portion and the end portion, wherein the end portion of the partition plate is arranged such that a direction normal to the end portion of the partition plate is along a radial direction with respect to an axis of rotation of a rotor;

the partition plate is provided to form a continuous cavity inside the vane structure and the end wall structure, the body portion, the end portion and the curved portion of the partition plate are provided with a plurality of penetration holes, and wherein the partition plate is disposed so as to have an equal gap between the end portion of the partition plate and an inner wall surface of the end wall structure.

2. The turbine vane according to claim 1, wherein the partition plate forms a cylindrical shape in a longitudinal sectional view, the partition plate having an enlarged portion near the end wall structure and an end of the partition plate being fixed to the end wall structure.

3. The turbine vane according to claim 1, wherein a protrusion is provided between the vane structure and the partition plate or between the end wall structure and the partition plate so as to suppress the gap therebetween from being narrowed.

4. The turbine vane according to claim 1, wherein the end wall structure includes an outer end wall structure connected to one end of the vane structure and an inner end wall structure connected to the other end of the vane structure, and the partition plate includes an outer partition plate inserted from the outer end wall structure and an inner partition plate inserted from the inner end wall structure.

5. The turbine vane according to claim 4, wherein the outer partition plate and the inner partition plate are formed so that base ends thereof are fixed to the outer end wall structure and the inner end wall structure and leading ends of the outer partition plate and the inner partition plate are bonded to each other.

6. The turbine vane according to claim 4, wherein the outer partition plate and the inner partition plate are formed so that the base ends are fixed to the outer end wall structure and the inner end wall structure respectively and a leading end of the outer partition plate and a leading end of the inner partition plate being disposed inside the vane structure with a predetermined gap therebetween.

7. The turbine vane according to claim 5, wherein a combustion gas path is provided outside the vane structure and the end wall structure, and the outer partition plate and the inner partition plate are disposed so that the leading ends avoid a portion with the highest combustion gas temperature of a vane body in a length direction.

8. The turbine vane according to claim 6, wherein a combustion gas path is provided outside the vane structure and the end wall structure, and the outer partition plate and the inner partition plate are disposed so that the leading ends avoid a portion with the highest combustion gas temperature of a vane body in a length direction.

* * * * *